US005402847A

United States Patent [19]

Wilson et al.

[11] Patent Number: 5,402,847

[45] Date of Patent: Apr. 4, 1995

[54] COAL BED METHANE RECOVERY

[75] Inventors: Dennis R. Wilson; Pat Lively; Jamal A. Sandarusi, all of Ponca City, Okla.; Pete Bowser; Matt Stanley, both of Midland, Tex.

[73] Assignee: Conoco Inc., Ponca City, Okla.

[21] Appl. No.: 279,571

[22] Filed: Jul. 22, 1994

[51] Int. Cl.[6] ..... E21B 43/24; E21B 43/30; E21B 43/40

[52] U.S. Cl. ..... 166/263; 166/272; 166/266

[58] Field of Search ..... 166/263, 272, 266, 245, 166/271; 299/13, 10, 12; 48/DIG. 6

[56] References Cited

U.S. PATENT DOCUMENTS

| | | | |
|---|---|---|---|
| 4,043,395 | 8/1977 | Every et al. | 166/263 |
| 4,883,122 | 11/1989 | Puri et al. | 166/263 |
| 5,072,990 | 12/1991 | Vogt, Jr. et al. | 166/272 X |
| 5,273,344 | 12/1993 | Volkwein et al. | 299/12 |

*Primary Examiner*—Stephen J. Novosad
*Attorney, Agent, or Firm*—Richard W. Collins

[57] ABSTRACT

A process for producing methane from a subterranean coal bed by continuously injecting a carbon dioxide-containing gas into the coal bed and recovering displaced and desorbed methane from a recovery well. The injection gas may be exhaust gas from a hydrocarbon fueled engine.

14 Claims, No Drawings

COAL BED METHANE RECOVERY

BACKGROUND OF THE INVENTION

1. Field of the Invention

This invention relates to production of methane from subterranean coal beds, and more particularly to a process in which a carbon dioxide-containing gas is continuously injected into one or more injection wells to produce methane from one or more recovery wells spaced from the injection wells. The produced methane includes both free methane displaced by the injection gas and methane that is desorbed from the coal surface by differential adsorption of carbon dioxide on the coal surface.

Much of the early work on recovering coal bed methane was driven by a need to reduce methane levels sufficiently to enable safe mining. More recently, deep unmineable coal beds have been utilized as a source of large volumes of methane for commercial purposes.

The primary mechanism of methane retention in coal beds is by adsorption on the coal surfaces within the matrix pore structure. This is a very different mechanism for gas storage than in conventional sandstone or limestone gas reservoirs, where free gas is compressed within the pore spaces. Within the meso and micropores of a coal bed there exists tremendous surface area on which methane molecules may be adsorbed.

Another important aspect of the coal reservoir is a set of natural fractures called cleats which form during the coalification process. The dominant cleat is referred to as the face cleat with the subordinate cleat, oriented roughly perpendicular to the face cleat, termed the butt cleat. These constitute the macroporosity of the reservoir and store a small amount of compressed gas, but are often filled with water. More importantly, however, they provide a permeability conduit through which methane can flow.

Many coalbed methane wells exhibit an unusual production profile with regard to both gas and water production rates. Initially, in virgin coalbeds, the cleats may be saturated with water. A period of water production is then required prior to gas production.

The movement of gas into the cleat system eventually results in two phase flow of water and gas. Initially the water saturates the fracture system and the gas is adsorbed to the coal matrix. Only water is flowing in the cleats. As the pressure declines and the cleats are partially dewatered, gas desorption occurs. Mostly water moves in the cleats as the gas slowly starts to move in the system. The gas saturation needs to exceed critical saturation before two phase flow happens in the fracture or cleats. Diffusion of gas, after desorption from the matrix, will continue to move the gas in the fracture, and two phase flow happens around the wellbore.

As a result of this mechanism, the gas production will typically lag the water production. As the pressure is reduced, the gas desorption rate will increase causing the gas production to reach a peak, after which it will decline as the gas is depleted in the drainage area of the well.

Many procedures have been proposed over the years for improving the results of conventional methane production techniques. Most of these procedures involve injection of a fluid into one or more injection wells to displace methane and recover the methane from recovery wells spaced from the injection wells.

2. Brief Description of the Prior Art

A process for removing methane from coal beds by injecting a carbon dioxide-containing fluid, ceasing injection and holding the injected fluid in the coal bed to enable desorption of methane, followed by recovery of desorbed methane through a recovery well, is described in U.S. Pat. No. 4,043,395 to Every et al. The Every et al. patent is directed to reducing methane in mineable coal seams to a safe level for mining, and indicates that continuous injection is not as effective as the periodic shut in procedure described therein.

U.S. Pat. No. 4,883,122 to Puri et al describes recovery of methane from coal beds by injection of an inert gas, such as nitrogen, that does not adsorb to the coal.

U.S. Pat. No. 5,133,406 to Puri describes a method of injecting oxygen depleted air from a fuel cell into a coal bed to increase methane production.

U.S. Pat. No. 5,072,990 to Vogt, Jr. et al describes a method of injecting hot water or steam into a coal bed to enhance methane recovery.

An article by Reznick et al entitled "An Analysis of the Effect of $CO_2$ Injection on the Recovery of In-Situ Methane from Bituminous Coal: An Experimental Simulation", *Society of Petroleum Engineers Journal,* October 1984, essentially confirms the process described in the Every et al patent discussed above.

While some of the above-described procedures have been successful to a degree, there has been a continuing need for improved procedures for recovery of coal bed methane.

SUMMARY OF THE INVENTION

According to the present invention, methane is recovered from a coal bed by continuously injecting a carbon dioxide-containing exhaust gas from a hydrocarbon-fueled internal combustion engine into the coal bed to sweep both free methane and methane which is preferentially desorbed by any carbon dioxide in the injected gas. The methane is recovered from one or more production wells spaced from the injection point.

DESCRIPTION OF THE PREFERRED EMBODIMENTS

In one embodiment, the injection gas is exhaust gas from a diesel engine. This exhaust gas can be injected directly from the engine, as technology is currently available to supply diesel engine exhaust directly from the engine at a pressure of 400 to 600 psig. If necessary, heating and/or compression of the engine exhaust gas can be utilized, as well as treatment of the exhaust gas for reduction of moisture and corrosive compounds.

In a process for recovering methane from a typical deep coal bed, the injection gas might be at a pressure of about 2000 psig and a temperature of from 350° to 600° F. Even higher temperatures are desirable if the gas handling equipment can tolerate such temperatures. Injection gas temperatures in this range can be provided by utilizing a large industrial diesel engine modified to provide a portion of the engine exhaust at about 400 to 600 psig. The gas may be cooled initially to remove moisture and corrosive compounds, and the cooled and dewatered exhaust gas can then be compressed to about 2000 psig, which raises the gas temperature to about 350° F. for injection. Compressing the gas to a higher pressure by additional stages of compression, and/or operating an oxygen converter downstream of the compressor, can produce gas temperatures of 600° F. or higher. The compressor is preferably driven by the engine providing the exhaust gas.

The injection gas pressure obviously has to be at least sufficient to overcome the coal bed pressure, and the higher the injection pressure the more rapidly the process will proceed.

The use of injection gas temperatures at or above 350° F. provides an overall increase in permeability of the coal bed, especially near the injection well, along with increased methane production. Water is a flow impediment when present in the coal bed cleats and matrices. The heat can vaporize the water with the vapor and remaining liquid water being expelled by the flow of injection gas. Dehydration causes the coal to shrink, which leads to enlargement of present cleats and creation of new interstices, resulting in increased permeability. The high temperature also minimizes adsorption of carbon dioxide near the injection well bore, thus preventing coal swelling and permeability reduction that would otherwise result from carbon dioxide adsorption. The high temperatures enhance desorption of methane which is adsorbed on the coal, with resultant shrinkage of the coal.

In situations where the gas handling equipment can tolerate temperatures above about 600° F., a gas turbine engine can be utilized to produce large volumes of very hot exhaust gas, which can be injected directly from the engine or compressed or otherwise conditioned as desired prior to injection.

In some embodiments, the engine providing the injection gas can be partly or wholly fueled by methane recovered in the process.

The permeability of the coal around the injection well can be further increased by cyclically varying the temperature of the injection gas to thermally expand and contract the coal around the injection well, thereby creating new fractures and enlarging existing fractures.

The pressure at the production well can be cyclically adjusted from a higher pressure to a lower pressure which in certain situations can expand the well cavity by breaking off coal from the well bore wall and expelling the broken coal out from the well bore by gas flow. Cyclic pressure replenishment at the production well results primarily from continuous injection of gas at the injection well.

Previous attempts to use a carbon dioxide containing gas in recovering coal bed methane have been discouraged because adsorption of large volumes of carbon dioxide would be expensive, and would also swell the coal and reduce permeability of the coal bed. These objections are largely overcome by the present invention which provides a very inexpensive source of carbon dioxide and which minimizes adsorption of carbon dioxide in the critical area around the injection well because of the use of hot injection gas, such as at 350° F. or above.

The process of this invention is well suited to a situation where a pattern of wells drilled into a coal bed have initially been used to produce connate water and associated gas from the coal bed. After initial water removal, a portion of the water removal wells can be converted to gas injection wells, and the remaining water removal wells can continue as methane producing wells.

EXAMPLE 1

In this example, a modified diesel engine provides an exhaust gas. The exhaust gas is cooled to remove moisture and corrosives. Compression provides a gas temperature of approximately 350° F. Exhaust gas is injected continously and directly into an injection well extending into a coal bed.

EXAMPLE 2

This example is similar to example 1 above, but the exhaust gas is obtained from a gas turbine engine. After startup of the process, the gas turbine is fueled with methane recovered from the production wells.

EXAMPLE 3

This example is similar to Example 1 above, but the diesel engine is fueled with a mixture of diesel fuel and methane recovered from the production wells.

EXAMPLE 4

In this example, a pattern of water removal wells is drilled into a deep unmineable coal bed. Water and associated gas is produced from the wells until most of the water is removed from the coal bed. Part of the wells are converted to gas injection, and a carbon dioxide containing gas at about 600 psig is obtained from a group of industrial diesel engines. The gas is cooled to remove water, compressed to about 2000 psig in compressors driven by the diesel engines, and injected through the injection wells into the coal bed at a temperature of about 350° F. The remaining original water removal wells, spaced about the gas injection wells, are then utilized to recover methane which is displaced and desorbed by the injection gas.

We claim:

1. A process for recovering methane from a coal bed comprising:

(a) recovering a carbon dioxide—containing exhaust gas from a hydrocarbon-fueled internal combustion engine;

(b) continuously injecting said exhaust gas into at least one injection well extending into said coal bed; and (c) continuously recovering produced gas, including methane from said coal bed, from at least one production well extending into said coal bed and being spaced apart from said at least one injection well.

2. The process of claim 1 wherein said exhaust gas is from at least one diesel engine.

3. The process of claim 1 wherein said exhaust gas is from at least one gas turbine engine.

4. The process of claim 3 wherein at least part of the fuel for said gas turbine engine is methane which has been recovered from said coal bed.

5. The process of claim 1 wherein said exhaust gas is injected at a temperature of a least 350° F.

6. The process of claim 1 wherein the pressure of at least one production of said wells is cyclically adjusted from a higher pressure to a lower pressure.

7. The process of claim 1 wherein said exhaust gas is treated for removal of moisture and corrosive compounds prior to injection.

8. The process of claim 1 wherein said exhaust gas is compressed to a pressure of at least 2000 psig prior to injection into said coal bed.

9. The process of claim 8 wherein said exhaust gas is passed through an oxygen converter prior to injection into said coal bed.

10. The process of claim 9 wherein said exhaust gas is at a temperature of from 350° to 600° F. and a pressure of about 2000 psig prior to injection into said coal bed.

11. A process for recovering methane from a coal bed comprising:

(a) drilling a plurality of water removal wells into said coal bed;

(b) recovering connate water and associated gas from said wells;

(c) converting a portion of said wells to gas injection wells, said gas injection wells being distributed in a pattern with each injection well being spaced from at least one remaining recovery well;

(d) obtaining carbon dioxide—containing exhaust gas from at least one diesel engine, said exhaust gas being at a pressure of from 400 to 600 psig;

(e) cooling said exhaust gas to remove moisture therefrom;

(f) compressing said exhaust gas;

(g) injecting said exhaust gas into said injection wells; and (h) recovering methane from said recovery wells.

12. The process of claim 11 wherein said exhaust gas is injected at a temperature of from 350° to 600° F. and a pressure of from 400 to 600 psig.

13. The process of claim 11 wherein said exhaust gas is compressed to about 2000 psig prior to injection.

14. The process of claim 13 wherein said exhaust gas is passed through an oxygen convertor after compression and prior to injection.

* * * * *